US006748764B1

(12) United States Patent
Roemer

(10) Patent No.: US 6,748,764 B1
(45) Date of Patent: Jun. 15, 2004

(54) SELF-ADJUSTING RING SIZE REDUCER

(76) Inventor: Thomas Bruce Roemer, 1163 First Capitol Dr., St. Charles, MO (US) 63301

( * ) Notice: Subject to any disclaimer, the term of this patent is extended or adjusted under 35 U.S.C. 154(b) by 0 days.

(21) Appl. No.: 09/954,752

(22) Filed: Sep. 18, 2001

Related U.S. Application Data

(63) Continuation-in-part of application No. 09/666,649, filed on Sep. 20, 2000, now abandoned.

(51) Int. Cl.[7] ..... A44C 9/02
(52) U.S. Cl. ..... 63/15.65; 63/15.5; 63/15.6
(58) Field of Search ..... 63/15.5, 15.6, 63/15.65

(56) References Cited

U.S. PATENT DOCUMENTS 2,615,314 A * 10/1952 Axel ..... 63/15.6
2,745,265 A * 5/1956 Grafstein ..... 63/15.6
2,745,266 A * 5/1956 Grafstein ..... 63/15.6
2,787,142 A * 4/1957 Axel ..... 63/15.6
3,380,263 A * 4/1968 Astor ..... 63/15.6
6,003,334 A * 12/1999 Miller ..... 63/15.5

* cited by examiner

*Primary Examiner*—J. J. Swann
*Assistant Examiner*—Katherine Mitchell
(74) *Attorney, Agent, or Firm*—Polster, Lieder, Woodruff & Lucchesi, L.C.

(57) ABSTRACT

A self-adjusting finger ring size reducing mechanism has spring biased arms pivotally mounted in a slot in the lower shank portion of a ring. The arms are urged into the finger opening by the springs comprised in the slot by the arms and are retained in the slot by a bridge across the top of the slot intermediate its ends which engages the free ends of the arms to limit their movement out of the slot. The mechanism can be retrofitted to existing finger rings.

23 Claims, 3 Drawing Sheets

SELF-ADJUSTING RING SIZE REDUCER

CROSS REFERENCE TO RELATED APPLICATIONS

This application is a continuation-in-part of application Ser. No. 09/666,649 filed Sep. 20, 2000 entitled Self-Adjusting Ring Size Reducer, now Abandoned.

STATEMENT REGARDING FEDERALLY SPONSORED RESEARCH OR DEVELOPMENT

Not applicable

BACKGROUND OF THE INVENTION

1. Field of the Invention

The present invention is directed to the jewelry art, particularly the finger ring art, and specifically to an improvement in self-sizing rings for reducing the effective size of a ring finger opening to provide a better fit for the user.

2. Description of Related Art

A problem often encountered by jewelers concerns a client who has developed large knuckles due to aging, weight gain, arthritis, etc., compared to the digital portion of the ring finger. Therefore, when a ring is made or adjusted to fit over the enlarged knuckle, it is too large for the digital portion of the ring finger and will tend to turn on the finger. This can occur with new rings or with older rings that need to be retrofitted.

A somewhat similar problem confronts jewelers when a ring is passed from one owner to another with the owners having different sized fingers. Rings can only be stretched or cut down within small limits without weakening the structure or introducing imperfections into the metal.

There also is a need for a product which can be incorporated into new rings during their fabrication to provide a better fit for the ring on the finger of the user. A ring so constructed then has the capability of adjusting to changes in the finger size of the owner or of subsequent owners.

There have been numerous attempts to address these problems. These include devices which clamp onto the ring shank and generally are flexible to accommodate different sized fingers. Typical such devices are shown in Gesensway U.S. Pat. No. 5,239,842; Gesensway U.S. Pat. No. 4,903,507; Lodrini U.S. Pat. No. 4,569,211; Ellenbecker et al U.S. Pat. No. 5,261,256; Buontempo et al. U.S. Pat. No. 5,253,491; Lodrini U.S. Pat. No. 4,480,447; Tucker U.S. Pat. No. 3,465,544; Doering U.S. Pat. No. 3,237,426; McKellar U.S. Pat. No. 1,481,297; Levin U.S. Pat. No. 1,754,392; Sokolof U.S. Pat. No. 2,010,444; McLees, Jr. U.S. Pat. No. 3,354,669; Bratman U.S. Pat. No. 2,532,354; Mayer U.S. Pat. No. 3,483,717; Virtanen U.S. Pat. No. 3,603,109; Mroz U.S. Pat. No. 4,215,556; Kaplan U.S. Pat. No. 4,471,634; Parks U.S. Pat. No. 4,538,430; and Rood U.S. Pat. No. 5,628,208. These all tend to add unsightly bulk to the ring, are very visible when the ring is worn, are uncomfortable, hard to install or not acceptable when installed in expensive custom made jewelry.

Other patents show devices which are completely or partially housed in the ring shank or in the ring setting and are movable into the space through which the finger is inserted. Such devices include Miller U.S. Pat. No. 5,636,531 which uses a lever arm, a set screw and an air cylinder in various embodiments to move a cradle into engagement with the digital portion of the user's finger. Erb U.S. Pat. No. 5,943,882 uses a movable bridge to adjust the size of the ring shank. Nesbit U.S. Pat. No. 3,835,664 attaches a magnetic disc to the ring beneath the setting. A shim, which is attracted to the magnetic disc is positioned inside the shank to reduce the size. Schechter et al. U.S. Pat. No. 3,360,959 has a sector pivotally mounted in a slot in the ring band with an undulating upper surface that is engaged with the digital position of the user's finger after the ring has been slipped onto the finger with the sector in open position. A catch allows the sector to be locked in closed position. Sessa U.S. Pat. No. 2,055,315 has a tongue and groove insert for positioning inside the ring shank to reduce its size.

There also are patents that utilize springs or other resilient means to reduce the size of the ring shank. Leone U.S. Pat. No. 3,590,598 utilizes a spring-biased detent to hold a size reducing element in closed position and permits it to be pivoted to an open position to allow the finger to be inserted into the ring shank. Martinez U.S. Pat. No. 4,223,541 provides a slot inside the shank and an opening in the bottom of the slot opposite the setting. Serrations are provided at the upper ends of the slot and a U-shaped band with resilient ends adapted to engage the serrations is located in the slot and provided with a tab which resides in the bottom slot opening. The band is moved upwardly and downwardly to adjust the size of the shank opening. Graftstein U.S. Pat. No. 2,745,265 attaches a frame beneath the setting and has pivotally mounted mobile elements spring biased into the shank area to reduce the ring size and movable into the setting area to increase the ring size. Axel U.S. Pat. No. 2,615,314 provides a spring-loaded movable sheet metal member positioned beneath the ring setting and normally reducing the size of the finger-receiving opening in the band. When it is moved into the ring setting area against the action of the springs, the opening is increased. Miller U.S. Pat. No. 6,003,334 shows a ring shank having a slot on the lower inside portion with a cradle adapted to move from the slot into finger engaging position by means of articulated hinges at each end and a leaf spring positioned in the slot which urges the cradle into finger engaging position. The hinges have slots and hinge pins movable in the slots to open and close the cradle. Many of these devices are difficult to produce and even more difficult to retrofit to existing rings.

To be practical when used with rings costing many thousands of dollars, ring size reducing devices need to be invisible to the user and those viewing the ring on the hand of the user, have a comfortable feel, and be able to be retrofitted to existing rings by competent jewelers.

BRIEF SUMMARY OF THE INVENTION

In my co-pending Ser. No. 09/666,649, I have disclosed a first finger ring size opening reducing device which comprises a ring shank which has a cavity in the lower portion which extends into the sides of the shank. Inside the shank cavity are a pair of ring size reducing members which are pivotally connected to the shank at their upper ends and have a notch in their free ends which allows limited movement into the finger opening while preventing total exodus from the cavity. Resilient means urge the size reducing members into the shank finger opening, while allowing the size reducing members to be to be moved completely into the cavity to let the ring move over an enlarged knuckle.

In the first embodiment of the invention shown in Ser. No. 09/666,649, two leaf springs are utilized, one beneath each size reducing member. A second embodiment shown in Ser. No. 09/666,649 has a single leaf spring with two arms, each of which engages and urges a size reducing member into the finger opening.

In this application are disclosed in detail several other embodiments of the invention, some of which were described briefly but not shown in the drawings of Ser. No. 09/666,649.

In particular, in one embodiment the present application discloses a ring shank having a slot in the lowermost portion with a size reducing member located in the slot and biased into the finger opening by a single leaf spring fixed in the slot and positioned beneath the size reducing member.

Another embodiment of this application discloses a ring shank having a slot in the lowermost portion with a single size reducing member pivoted at one end of the slot and biased into the finger opening by a single leaf spring located in the slot beneath the size reducing member.

Still another embodiment of this application has a ring with a slot in the lower shank portion and a novel coil spring having coils at each end and a coil in the center positioned in the slot beneath pivoted arms at each end of the slot to bias the arms into the finger opening.

Another embodiment disclosed in this application involves a self-contained size reducing unit which is inserted into a slot cut into the lower shank of a ring and anchored therein. The unit has an element or elements which are urged into the finger opening.

As noted in Ser. No. 09/666,649, the invention is applicable to a conventional ring shank of uniform thickness and to a counterweighted ring shank having extra thickness at its lower portion. As shown, the invention can utilize leaf springs and other resilient compressible elements, such as, coil springs, resilient polymeric material and the like.

Also as shown, a single size reducing member pivoted at one end in a slot on the ring shank and restrained on the shank at its free end also can be used.

It is therefore a principal object of the invention to provide a self-adjusting ring size reducer which allows passage of a ring over a user's knuckle (often enlarged) while still providing a comfortable and satisfactory fit on the digital portion of the user's finger. A further object is to provide a ring size adjustment mechanism which fits unobtrusively into the ring shank and which can be retrofitted to existing rings. It is still another object of the present invention to provide a ring size reducer which does not impair the ring setting site, does not protrude on the side edges of the ring, and is virtually unnoticeable when the ring is on the finger of the user.

These and other objects and advantages will become apparent in connection with the following detailed description and drawings.

BRIEF DESCRIPTION OF THE SEVERAL VIEWS OF THE DRAWINGS

In the drawings, wherein like numerals and letters refer to like parts wherever they occur.

DETAILED DESCRIPTION OF INVENTION

Figure 1:
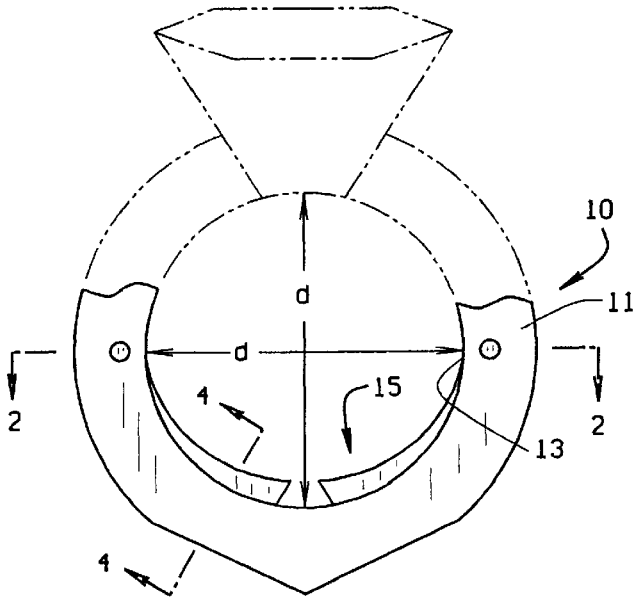
FIG. 1 is a fragmentary front elevational view of the invention, applied to a ring shank with a portion of the shank shown in solid lines and the remainder of the setting shown in broken lines.
Figure 3:
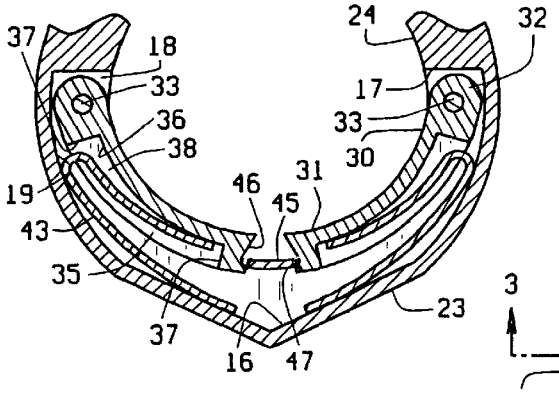
FIG. 3 is a sectional view taken along line 3—3 of FIG. 2.
Figure 2:
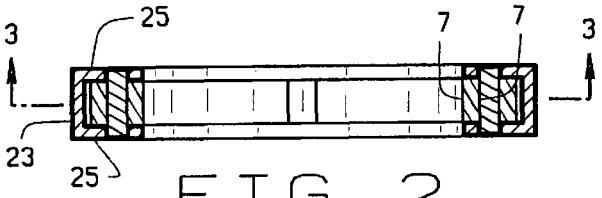
FIG. 2 is a sectional view taken along line 2—2 of FIG. 1.
Figure 4:
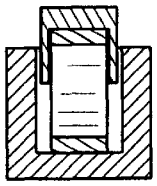
FIG. 4 is a sectional view taken along line 4—4 of FIG. 1.

A first embodiment of the present invention is shown in FIGS. 1–5 applied to a finger ring is having a shank portion 11 and a setting 12 (shown in broken lines in FIG. 1). The setting 12 forms no part of this invention except that it is not encumbered in any way by the ring shank size adjusting mechanism.

The ring shank 11 defines a finger receiving opening 13 whose nominal size is defined by the distance "d" shown in FIG. 1. Positioned in the lower portion of the shank 11 opposite the setting 12 is a ring shank size reducing mechanism 15. The size reducing mechanism 15 is housed in a recess 16 formed in the lower portion of the ring shank 11. The recess 16 has end walls 17, side walls 18 and a bottom wall 19.

The ring shank 11 itself has an outer edge surface 23, an inner edge surface 24, and outer side surfaces 25.

The ring shank reducing mechanism 15 comprises a pair of opposed arms 30, each having an arcuate finger engaging inner surface 31, and a shoulder 32 pivotally attached in the shank recess 16 adjacent to the end walls 17 by a pivot pin 33.

Each of the arms 30 is provided with an internal recess 35 defined by a base 36 opposite the finger engaging surface 31, end walls 37 and side walls 38. The recesses 35 defined by the surfaces 36,37,38 have an open top which is opposite to the bottom wall 19 of the shank recess 16.

Trapped between the surfaces 19 and 36 and retained in the recesses 33 are leaf springs 43 which are compressed between the surfaces 19 and 36 and urge the arms 30 away from the shank 11 into the finger receiving opening 13.

A bridge 45 connects the recess side walls 18 adjacent to the bottom of the shank 11. The purpose of the bridge 45 is to limit the movement of the arms 30 into the finger receiving opening 13. To this end, the free ends of the arms 30 are defined by angularly intersecting surfaces 46,47. The lower surfaces 47, i.e., the surfaces closer to the shank recess bottom wall 19, are inclined toward each other and are positioned beneath the bridge 45. Thus, they engage the bridge 45 and hold the arms 30 in the recesses 16.when the springs 43 move the arms 30 into the shank opening 13.

The upper inclined surfaces 46 also slope toward each other, but are so angled to allow the arms 30 to be moved into the shank recess 16 to maximize the size of the finger receiving opening 13.

Figure 7:
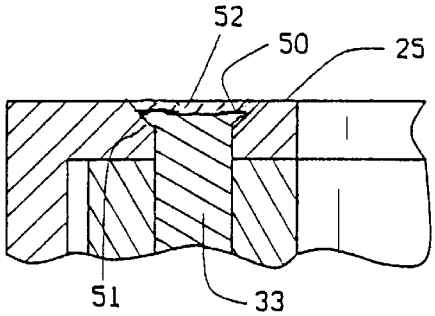
FIG. 7 is an enlarged fragmentary sectional view showing the pin holding the finger engaging arms recessed in the side wall of the ring shank.

To provide a finished appearance to the shank outside surfaces 25, the pins 33 are recessed in the shank 11. As shown in detail in FIG. 7, a countersink opening 50 is provided in the shank side surface 25 and the head of the pin 33 is flared at 51 to retain the pin 33 in the countersink 50. Then the remainder of the countersink 50 is filled with gold, platinum or silver 52, depending on the shank material, and polished so no trace of the pinhead remains.

Figure 6:
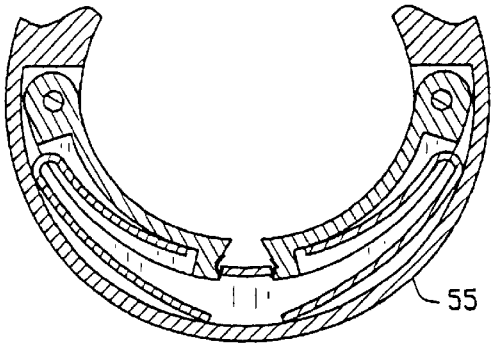
FIG. 6 is a sectional view similar to FIG. 3, but showing a modification of the ring shank.

FIG. 6 shows the invention applied to a modified shank 55 which does not have a counterweight area at the bottom portion. The remainder of the invention is the same as hereinbefore described.

Figure 8:
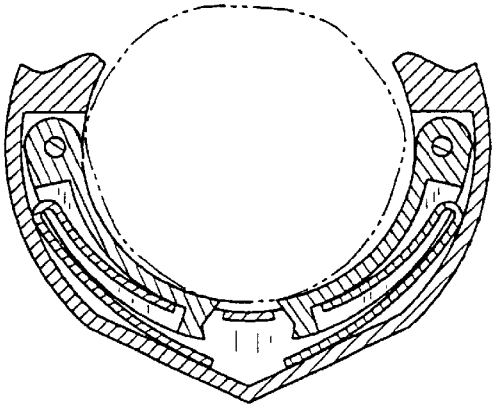
FIG. 8 is a sectional view similar to FIG. 3, but showing the ring size reducing elements depressed into the ring shank cavity as the ring passes over the knuckle of the user.

FIG. 8 shows still another modification of the invention. The form of the invention shown in FIG. 5 utilizes a continuous leaf spring 58 which has a continuous base portion 59 and two opposed legs 60 which are housed in the arm recesses 35. The base portion 59 is located in the shank recess 16. This form of the invention functions as hereinbefore described with respect to FIGS. 1–4.

As will be described hereinafter the leaf springs 43,58 can be replaced by coil springs and the like. As also is described hereinafter, the scope of the invention includes combining the arms 30 into a unitary member pivoted at one end in the shank recess and restrained in the recess at its free end.

FIG. 8 shows the arms 30 in depressed condition and shows in broken lines the enlarged knuckle of a user passing through the ring finger receiving opening.

Figure 9:
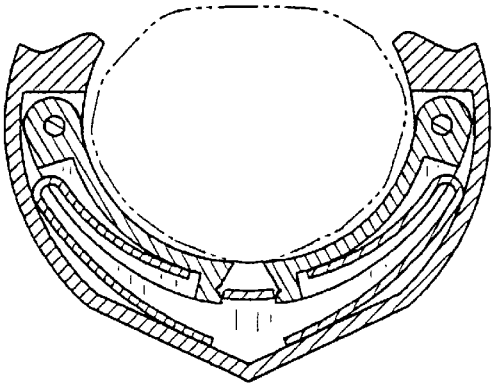
FIG. 9 is a view similar to FIG. 8 showing the ring on the digital part of the user's finger.

FIG. 9 shows the digital portion of the user's finger with the arm engaging surface 31 engaging the digital portion of the user's finger.

Figure 10:
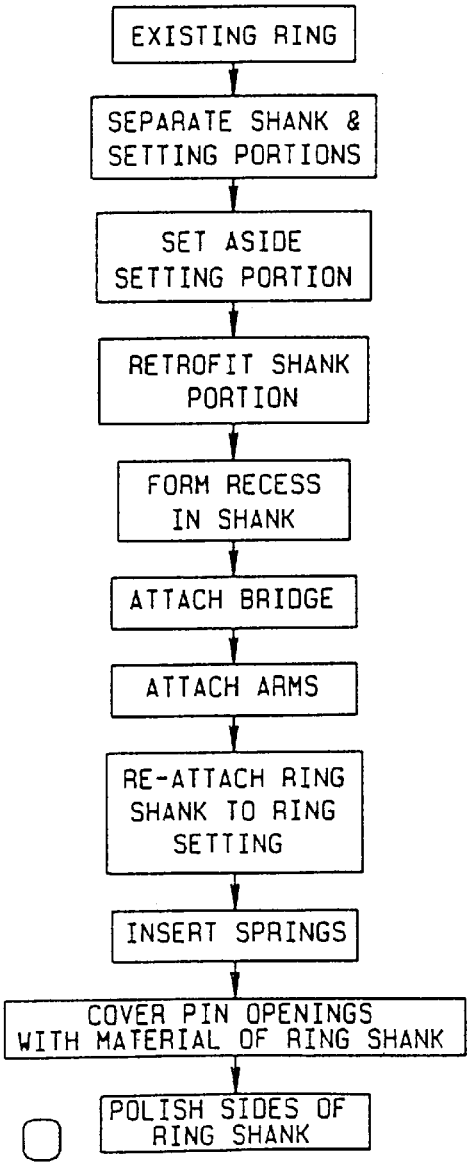
FIG. 10 is a diagrammatic flow chart showing the steps of applying the present invention to an existing ring.

Another important aspect of this invention is its applicability to retrofitting of an owner's ring. This is shown schematically in FIG. 10. In this form of the invention, the existing ring is divided to separate the shank and the setting areas. The setting area is set aside, while the shank portion is retrofitted.

To retrofit the shank portion, a recess 16 is formed in the shank portion. The bridge 45 is applied across the open side of the recess. At this time, the arms 30 are attached using the pins 33.

An important application is to reweld or resolder the shank to the setting before inserting the springs 43, 58. Since the springs are tempered, excessive heat from the welding operation could cause loss of temper and obviate the effectiveness of the spring.

The next step is to insert the springs 43,58 into the recesses 16,35.

The final step in the assembly process is to apply a gold, silver, or platinum covering 52 to the pinhead 50 and polish the shank outer side walls to eliminate any evidence of the presence of the pins.

Figure 11:
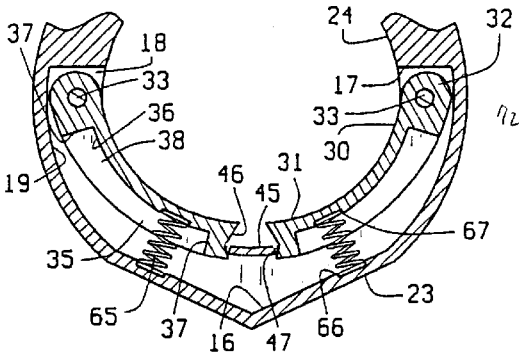
FIG. 11 is a fragmentary sectional view showing another modification of the invention.

FIG. 11 shows a modification of the invention in which the leaf springs 19 are replaced by coil springs 65. The coil springs 65 are positioned in a well 66 located in the shank 16 and a well 67 located in the arm inner surface 36, respectively. In lieu of the coil springs 65, resilient polymeric members can be placed in the wells 66 and 67.

Figure 12:
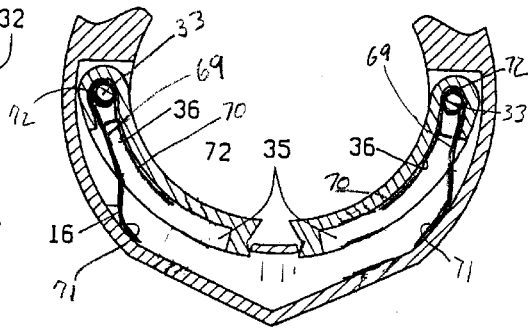
FIG. 12 is a fragmentary sectional view showing another modification of the invention.

FIG. 12 shows a presently preferred modification of the invention in which the leaf springs 19 are replaced by different kinds of springs, namely, a pair of combination leaf and coil springs 69. Each of the springs 69 has leg members 70 and 71 which engage the recess base 36 in the arms 30 and the ring shank recess 16, respectively. Connecting the legs 70,71 are spring coils 72 in which are positioned the pivot pins 33 which anchor the arms 30 to the shank 11. The spring legs 70,71 urge the shank size reducing arms 33 into the finger area of the ring shank.

Figure 14:
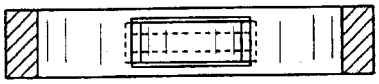
FIG. 14 is a sectional view taken along line 14—14 of FIG. 13.
Figure 13:
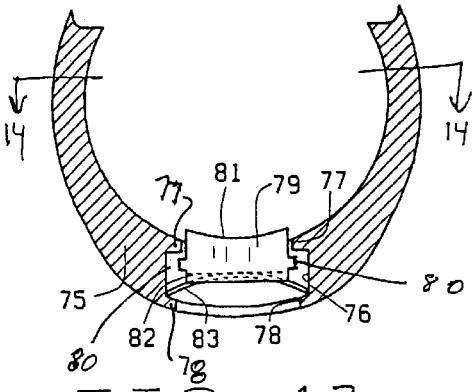
FIG. 13 is a fragmentary sectional view of another modification of the invention.

FIGS. 13 and 14 show another modification of the invention in which only a single spring and a single shank size reducing member is used. In this embodiment the ring shank 75 is provided with a shaped slot 76 through the lowermost portion.

The slot 76 is stepped and at its upper end has opposed lip stops 77, and at its lower end opposed spring retainer tabs 78. A size reducing member 79 is positioned in the slot 76 and has outwardly extending arms 80 adapted to engage the lip stops 77 to restrict movement of the member 79 into the shank finger opening.

The size reducing member 79 preferably has an arcuate finger engaging surface 81 of the same contour as the ring shank inner surface. A spring retainer slot 82 is formed in the opposite lower surface of the member 79 and accepts an arcuate leaf spring 83. The spring 83 is retained in the slot 76 by the spring retainer areas 78. The spring 83 urges the size reducing member 79 into the shank finger opening.

The arms 80 and the space between the tabs 78 are sized to allow the arms 80 to pass the tabs 78 when the size reducing member 79 is inserted into the slot 7. The spring 83 also is inserted between the tabs 78 to assemble the unit. If desired, the area between the tabs 78 can be filled and polished.

Figure 5:
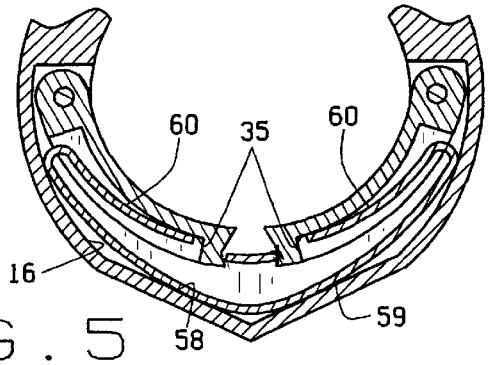
FIG. 5 is a sectional view similar to FIG. 3, but showing a modification of the spring.
Figure 15:
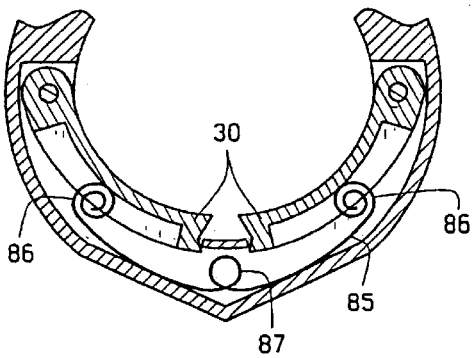
FIG. 15 is a fragmentary sectional view of another modification of the invention.

FIG. 15 shows another modification of the invention which is closely related to the forms of FIGS. 5 and 12 except that a different type of spring is used. In the embodiment of FIG. 15, two size reducing arms 30 are used. The spring 85 is a combination form of leaf and coil spring. It is a continuous spring and has arm engaging coils 86 at each end and a center coil 87. The end coils 86 urge the pivoted arms 30 into the finger area of the ring shank.

Figure 16:
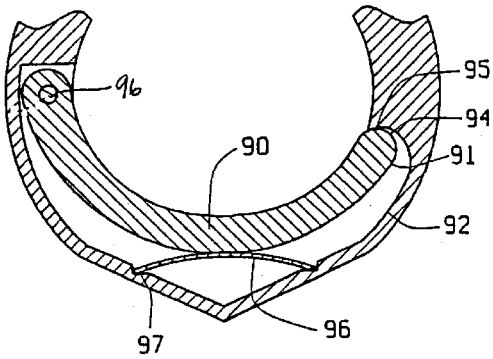
FIG. 16 is a fragmentary sectional view of another modification of the invention.

FIG. 16 shows still another modification of the invention involving only a single size reducing arm which is pivoted at one end. The arm 90 is designed to fit in a slot 91 in the lowermost portion of a ring shank 92. The arm 90 is pivoted at one end 93 to the ring shank 92 and the other free end 94 is retained in the slot 91 by a lip 95. A spring 96 is retained in the slot 91 by opposed spring retainers 97 and engages the underside of the arm 90 to urge it into the shank finger opening.

Thus, it is apparent that the present invention achieves all of the objects and advantages sought therefor.

This invention is intended to cover all changes and modifications of the example of the invention herein chosen for purposes of the disclosure which do not constitute departures from the spirit and scope of the invention.

Thomas Bruce Roemer Parts List
Self-Adjusting Ring Size Reducer Roem 7844US

"d"nominal size of ring shank opening 10. ring
11. shank

-continued

| "d"nominal size of ring shank opening |
|---|
| 12. setting |
| 13. finger receiving opening |
| 14. |
| 15. ring shank reducing mechanism |
| 16. recess in ring shank reducing mechanism |
| 17. end walls |
| 18. side walls |
| 19. bottom wall |
| 20. |
| 21. |
| 22. |
| 23. outer edge of shank |
| 24. inner edge of shank |
| 25. side surfaces of shank |
| 26. |
| 27. |
| 28. |
| 29. |
| 30. arms of 15 |
| 31. arm finger engaging surface |
| 32. shoulder |
| 33. pivot pin |
| 34. |
| 35. internal recess in 30 |
| 36. base of 35 |
| 37. end walls of 35 |
| 38. side walls of 35 |
| 39. |
| 40. |
| 41. |
| 42. |
| 43. leaf-springs |
| 44. |
| 45. bridge |
| 46. surface on arm end |
| 47. surface on arm end |
| 48. |
| 49. |
| 50. counter-sink opening |
| 51. flair of pin |
| 52. filler |
| 53. |
| 54. |
| 55. shank |
| 56. |
| 57. |
| 58. continuous leaf-spring |
| 60. arms of 59 |
| 61. |
| 62. |
| 63. |
| 64. |
| 65. coil springs |
| 66. wells in 16 |
| 67. wells in 36 |
| 68. |
| 69. combination coil and leaf spring |
| 70. leg |
| 71. leg |
| 72. coil spring |
| 73. |
| 74. |
| 75. ring shank |
| 76. slot |
| 77. lip stop of 76 |
| 78. spring retainer tabs |
| 79. size reducing member |
| 80. arms on 79 |
| 81. finger engaging surface of 79 |
| 82. spring retainer slot of 79 |
| 83. leaf spring |
| 84. |
| 85. spring |
| 86. end coils of 85 |
| 87. center coil of 85 |
| 88. |

-continued

| "d"nominal size of ring shank opening |
|---|
| 89. |
| 90. arm |
| 91. slot |
| 92. ring shank |
| 93. pivot |
| 94. free end |
| 95. lip |
| 96. spring |
| 97. spring retainers |
| 98. |
| 99. |
| 100. |
| 101. |
| 102. |
| 103. |
| 104. |
| 105. |
| 106. |
| 108. |
| 109. |
| 110. |
| 111. |
| 112. |
| 113. |

What is claimed is: Having thus described the invention, what is claimed and desired to be secured by Letters Patent is:

1. A finger ring comprising a setting, a shank having an inner wall, an exterior surface and a lower portion opposite the setting and defining a finger opening having an inwardly opening slot recessed in the inner wall thereof, said slot extending around the lower portion of said shank opposite the setting and terminating on each side of said setting, a pair of size reducing arm members pivotally positioned at one end in said slot and retained therein, a pair of springs each having legs compressed between the free ends of the size reducing arms and the ring shank slot and a coil connecting the legs, the coils being positioned in the arms, the spring biasing the arm members away from said slot into the finger opening to reduce the size of the finger opening, the arm members being movable into the slot to define the maximum size of the finger opening of said shank.

2. The finger ring of claim 1 including a bridge across the slot in the shank intermediate the ends of the slot adapted to engage the free ends of the arms to limit movement of the arms into the finger opening while allowing movement of the arms into the slot.

3. The finger ring of claim 2 wherein the free ends of the arms have an oblique surface adapted to engage the bridge to retain the arms in the shank slot.

4. The finger ring of claim 1 wherein the arms each have an opening therein opposite the slot bottom wall for retaining one leg of the spring.

5. The finger ring of claim 1 wherein the arm member is attached to the shank by a pivot pin having ends located in recesses in the outer surface of the shank and the recesses are filled with the same material as the ring shank and polished to effectively mask said pin ends and the recesses.

6. A finger ring size reducing mechanism adapted to be attached to a finger ring which defines a finger opening and has a setting and a shank with a lower portion opposed to the setting, the shank defining a slot in the lower portion which slot has a base which is open to the finger opening, the size reducing mechanism comprising a pair of arms, each having an underside and adapted to be pivotally connected at one of their ends to the shank and having the other end free and adapted to be positioned in the shank slot, biasing sprig means having legs positioned between the free ends of the size reducing arms and ring shank slot and arcuate portions connecting the legs, the arcuate portions positioned at least partially in the arm, the spring biasing the arms away from the slot into the finger opening to reduce the size of the finger opening, the alms adapted to be moved into the slot opposite the setting to define the maximum size of the finger opening.

7. The finger ring size reducing mechanism of claim 6 including a bridge adapted to be positioned across the slot in the shank intermediate the ends of the slot and adapted to engage the free ends of the arms to limit movement of the arms into the finger opening while allowing movement of the arms into the slot.

8. The finger ring size reducing mechanism of claim 7 wherein the free ends of the arms have an oblique surface adapted to engage the bridge to retain the arms in the shank slot.

9. The finger ring size reducing mechanism of claim 6 wherein the arms each have an opening therein adapted to be positioned opposite the slot base for retaining one leg of a spring.

10. The finger ring size reducing mechanism of claim 6 wherein the biasing device is a single spring having opposed free legs engaging the undersides of the arms, said spring being adapted to be compressed between the base of the slot and the arms and normally urging the arms into the finger opening.

11. The finger ring size reducing mechanism of claim 6 wherein the arms are adapted to be attached to the shank by a pivot pin having ends adapted to be fixed in recesses in the outside walls of the shank and the recesses are adapted to be filled with the same material as the ring shank and polished to effectively mask said pin ends and the recesses.

12. A finger ring comprising:

a) a setting, b) a shank having an inner wall, an exterior surface and a lower portion opposite the setting, the shank defining a finger opening having an inwardly opening slot recessed in the inner wall thereof opposite the setting, said slot having a base facing the finger opening, wherein the slot has opposed ends and an open top, c) a finger opening size reducing member positioned in the slot and retained therein, and having a pair of arms pivoted adjacent the ends of the slot with each arm having a free end, d) biasing spring means having legs positioned between the size reducing member and ring shank slot and arcuate portions connecting the legs, the arcuate portions positioned at least partially in the size reducing members, the spring means biasing the size reducing member outwardly from the slot into the finger opening opposite the setting to reduce the size of the finger opening, e) the size reducing member being movable into the slot to define the maximum finger opening size of said shank.

13. The finger ring of claim 12 wherein the biasing means comprises coil springs positioned at the free ends of the arms between the arms and the base of the slot.

14. The finger ring of claim 13 including a bridge across the slot in the shank intermediate the ends of the slot adapted to engage the free ends of the arms to limit movement of the arms into the finger opening while allowing movement of the arms into the slot.

15. The finger ring of claim 12 wherein the size reducing member is a pair of arms each pivotably connected at one of their ends to the shank with the other end free and the biasing means is a single leaf spring having coils at its ends beneath the free ends of the arms.

16. The finger ring of claim 12 wherein the size reducing member is a single arm pivoted at one end to the slot and a leaf spring is positioned beneath the arm between the arm and the slot.

17. The finger ring of claim 12 wherein the size reducing member is trapped in the slot and urged into the finger opening by a leaf spring positioned between the size reducing member and the base of the slot.

18. A finger ring comprising a setting, a shank having an inner wall, an exterior surface and a lower portion opposite the setting and defining a finger opening having an inwardly opening slot recessed in the inner wall thereof, said slot extending around the lower portion of said shank opposite the setting and terminating on each side of said setting, an arm member including a pair of arms pivotally connected at one of their ends to the shank and positioned in said slot, the other of their ends being fee and unattached, the slot having a bottom wall and the arms having undersides opposed to said slot bottom wall, a single spring having opposed free legs engaging the undersides of the arms, said spring being compressed between the bottom wall of the slot and the arms and normally urging the arms into the finger opening, to reduce the size of the finger opening, the arm member being movable into the slot to define the maximum size of the finger opening of said shank.

19. The finger ring of claim 18 wherein the arms each have an opening therein opposite the slot bottom wall for retaining the fee legs of the spring.

20. A finger ring size reducing mechanism adapted to be attached to a finger ring which defines a finger opening and has a setting and a shank with a lower portion opposed to the setting, the shank defining a slot in the lower portion which slot has a base which is open to the finger opening, the size reducing mechanism comprising a pair of arms, each having an underside and adapted to be pivotally connected at one of their ends to the shank and having the other end free and adapted to be positioned in the shank slot, a single spring having opposed free legs engaging the undersides of the arms, said spring being adapted to be compressed between the base of the slot and the arms and normally urging the arms into the finger opening to reduce the size of the finger opening, the arms adapted to be moved into the slot opposite the setting to define the maximum size of the finger opening.

21. The finger ring size reducing mechanism of claim 20 wherein the arms each have an opening therein adapted to be positioned opposite the slot base for retaining the free legs of the spring.

22. A finger rig comprising:

a) a setting, b) a shank having an inner wall an exterior surface and a lower portion opposite the setting, the shank defining a finger opening having an inwardly opening slot recessed in the inner wall thereof opposite the setting, said slot having a base facing the finger opening, c) a finger opening size reducing member positioned in the slot and retained therein, and d) a biasing device positioned in the slot biasing the size reducing member outwardly from the slot into the finger opening opposite the setting to reduce the size of the finger opening, e) the size reducing member being movable into the slot to define the maximum finger opening size of said shank, the size reducing member being a pair of arms each pivotably connected at one of their ends to the shank with the other end free and the biasing device being a single leaf spring having coils at its ends beneath the free ends of the arms.

23. A finger ring comprising a setting, a shank having an inner wall, an exterior surface and a lower portion opposite the setting and defining a finger opening having an inwardly opening slot recessed in the inner wall thereof, said slot extending around the lower portion of said shank opposite the setting and terminating on each side of said setting, a pair of arms pivotally connected at one of their ends to the shank, the other of their ends being free and unattached and positioned in said slot, a pair of springs each having legs compressed between the free ends of the size reducing arms and the ring shank slot and a coil connecting the legs, the coils being mounted on the pivots connecting the arms to the shank, the springs biasing the arms away from said slot into the finger opening to reduce the size of the finger opening, the arms being movable into the slot to define the maximum size of the finger opening of said shank.

* * * * *